United States Patent [19]

Ting

[11] Patent Number: 4,785,600

[45] Date of Patent: Nov. 22, 1988

[54] BUILDUP COMPOSITE BEAM STRUCTURE

[76] Inventor: Raymond M. L. Ting, 318 Holiday Dr., Pittsburgh, Pa. 15237

[21] Appl. No.: 155,739

[22] Filed: Feb. 16, 1988

[51] Int. Cl.[4] ..... E04B 1/16

[52] U.S. Cl. ..... 52/334; 52/336; 52/414

[58] Field of Search ..... 52/333, 334, 340, 723, 52/602, 326, 327, 328, 329, 336, 337, 338, 339, 414

[56] References Cited

U.S. PATENT DOCUMENTS

| | | | |
|---|---|---|---|
| 1,768,626 | 7/1930 | Pedersen | 52/333 |
| 2,340,176 | 1/1944 | Cueni | 52/334 |
| 2,636,377 | 4/1953 | Hilpert | 52/326 |
| 3,110,049 | 11/1963 | Nagin | 52/338 |
| 3,251,167 | 5/1966 | Curran | 52/327 |
| 3,282,017 | 11/1966 | Rothermel | 52/334 |
| 3,300,932 | 1/1967 | Ratliff | 52/339 |
| 3,385,015 | 5/1968 | Hadley | 52/334 |
| 3,527,007 | 9/1970 | McManus | 52/327 |
| 3,596,421 | 8/1971 | Miller | 52/333 |
| 4,333,280 | 6/1982 | Morton | 52/167 |
| 4,646,493 | 3/1987 | Grossman | 52/334 |
| 4,653,237 | 3/1987 | Taft | 52/338 |
| 4,716,695 | 1/1988 | Alexander | 52/167 |
| 4,729,201 | 3/1988 | Laurus | 52/334 |
| 4,741,138 | 5/1988 | Rongoe | 52/336 |

*Primary Examiner*—John E. Murtagh

*Attorney, Agent, or Firm*—William J. Ruano

[57] ABSTRACT

This invention relates to the construction of a composite beam structure in a composite steel deck floor system. A T-shaped beam is welded through the valleys of the steel deck onto the top flange of the supporting beam. After concrete pouring, the T-beam is buried within the concrete slab to act as the shear transferring device to achieve the composite beam action. The T-beam also serves to strengthen the supporting beam in resisting the load during the concreting operation and to facilitate the placement of the concrete shrinkage control wire mesh.

3 Claims, 3 Drawing Sheets

BUILDUP COMPOSITE BEAM STRUCTURE

BACKGROUND OF THE INVENTION

1. Field of the Invention

This invention relates to the construction of composite beams in a composite steel deck floor system.

2. Description of the Prior Art

The utilization of composite action between a concrete floor slab and the floor supporting beam is well known in the art. To achieve the composite beam action, it is required to install a shear transferring device such that a compressive bending force can be developed within the cured concrete slab. This type of design is known as a composite beam design. If there is no shear transferring device provided, the floor supporting beam must be designed to resist the total imposed load and is known as a non-composite beam design. It is well known in the art that the beam strength and stiffness are greatly increased in a composite beam design as compared to a non-composite beam design. Therefore, the composite beam design has been continuously gaining popularity in the building industry. Shear studs are commonly used in the composite beam design and are installed in the following procedures. The first step is to secure the steel decks to the supporting beams. The second step is to weld the shear studs at the valleys of the steel deck profile through the steel deck onto the top flange of the supporting beam. The third step is to place the concrete shrinkage control wire mesh at 1 inch (25.4 mm) below the finished concrete slab. The fourth step is to pour and to finish the concrete slab.

In the selection of the beam size in a composite beam design, the following two factors must be considered. First, the non-composite strength of the beam must be adequate to resist the dead weight of the floor and the construction loads. Second, upon curing of the floor slab, the composite strength of the composite beam must be adequate to resist the total imposed loads including the dead load and the design live load on the floor.

The drawbacks of the prior art composite beam design include the following items.

1. In most cases, the beam size is governed by the required non-composite beam strength during the erection period.

2. The efficiency of the shear stud is affected by the concrete rib geometry formed by the valleys of the steel deck profile. The wider the concrete rib, the higher the stud efficiency. The deeper the steel deck, the lower the stud efficiency. In some cases, only a partial composite design can be achieved due to a reduction of the stud efficiency induced by the steel deck profile or the available rib locations for stud welding.

3. The concrete shrinkage control mesh is supported by spaced apart plastic chairs. The plastic chairs can be easily knocked down during the concreting operation resulting in ineffective concrete shrinkage control due to mislocated wire mesh.

SUMMARY OF THE INVENTION

The objectives of this invention include the following items.

1. To provide a shear transferring device such that the efficiency of shear transfer is not affected by the steel deck profile.

2. To utilize the shear transferring device to strengthen the noncomposite strength of the beam such that the beam size can be reduced to effectively reduce the building height.

3. To utilize the shear transferring device to secure the concrete shrinkage control mesh without using plastic supporting chairs.

4. To utilize the shear transferring device to strengthen the inplane shear resistance to improve the seismic resistance of the floor system.

DESCRIPTION OF THE PREFERRED EMBODIMENTS

Figure 1:
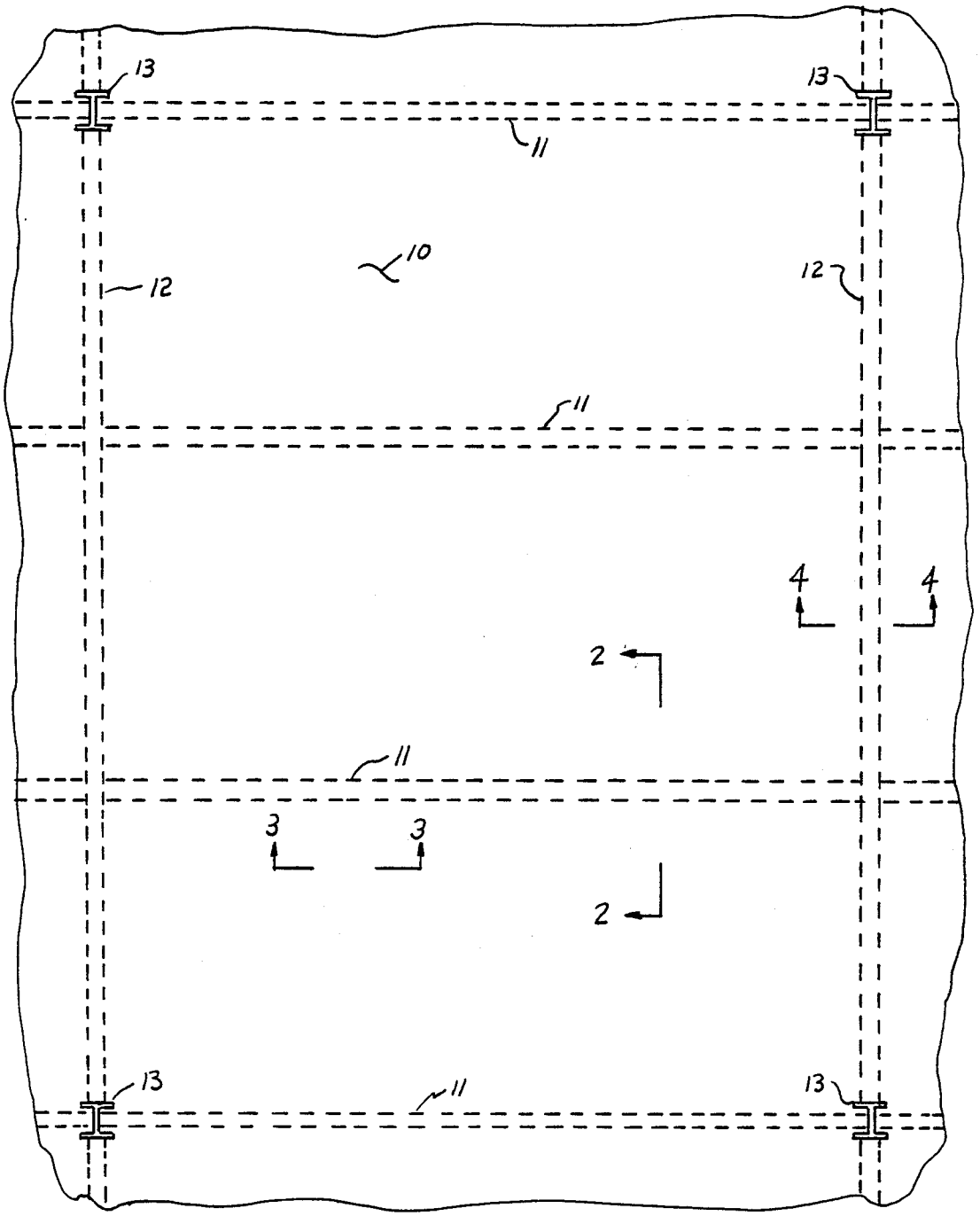
FIG. 1 is a plan view of a partial floor structure showing a typical floor bay of invention.

FIG. 1 is a plan view of a typical bay of a floor system incorporating the composite beam design of this invention. The composite steel deck slab 10 spans between composite beams 11 of this invention. The composite beams 11 span between building columns 13 or composite girders 12 of this invention.

Figure 2:
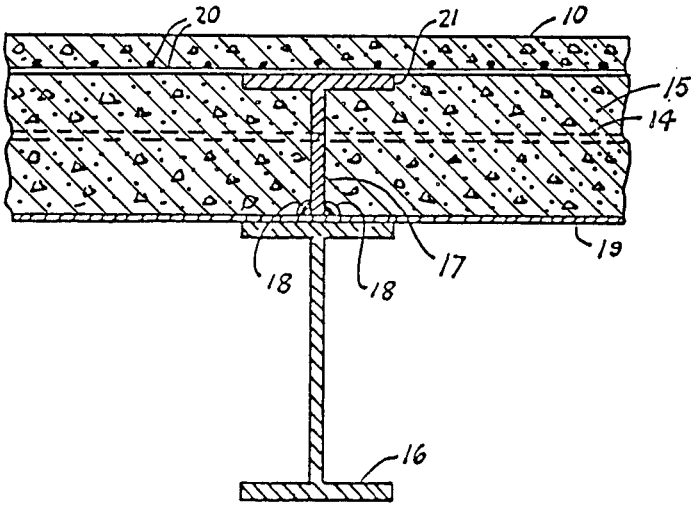
FIG. 2 is a typical fragmentary cross-sectional view taken along line 2—2 of FIG. 1 showing the cross-section of the composite beam construction of this invention.

FIG. 2 shows a typical cross-section of the composite beam of this invention taken along line 2—2 of FIG. 1. The composite concrete slab 10 comprises steel decks 14 and an overlaying concrete layer 15. The steel decks 14 are supported on the top flange of the supporting beam 16. A continuous piece of T-beam 17 is structurally connected to the supporting beam 16 by welds 18 penetrating through the bottom flange 19 of the steel deck 14. The concrete shrinkage control mesh 20 is secured at the top flange 21 of the T-beam 17. Upon curing of the overlaying concrete 15, the supporting beam 16, the T-beam 17, and the overlaying concrete 15 will act together in a composite fashion to establish the composite beam of this invention. Many advantages ar achieved by this invention as compared to the studded composite beam design of the prior art as itemized below.

1. In a studded composite beam design, the studs do not contribute any beam strength before the curing of concrete. Thus, the supporting beam 16 must be sized to resist the weight of the steel deck 14, the weight of the concrete 15, and the imposed construction load during the concreting operation. In the buildup composite beam design of this invention, the supporting beam 16 is required only to resist the weight of the steel deck without the weight of concrete while the combined strength of the supporting beam 16 and the T-beam 17 is available to resist the total load during erection. Therefore, the combined size of the supporting beam 16 and the T-beam 17 is equivalent to a single supporting beam of the studded composite beam design. It becomes apparent that a saving in the ceiling height equaling the height of the T-beam 17 is achieved by this invention, since the entire T-beam 17 is buried within the depth of the floor slab. For a highrise building, the saving in the ceiling height of each floor will result in a significant reduction of building height. Segments of the T-beams 17 can be strategically located at the regions of high bending moment rather than covering the entire length of the supporting beam 16.

2. In a studded composite beam design, the resistance against slab buckling relies on the enlarged stud head to hold down the concrete slab. In the buildup composite beam design of this invention, the floor slab is continuously locked under the long extended top flange 21 of the T-beam 17. Therefore, significant improvement in the hold down capability is achieved allowing the development of high strain in the concrete slab without composite failure. The common problem of longitudinal concrete cracks on top of a studded composite beam is eliminated by this invention.

3. The top flange 21 of T-beam 17 serves to automatically position the wire mesh 20 without the use of mesh supporting plastic chairs.

4. In the buildup composite beam design of this invention, the upward movement of the slab is restrained by the top flange of the T-beam 17 and the lateral movement of the slab is restrained by the vertical leg of the T-beam 17. Therefore, the in-plane shear resistance, which is a direct measurement of the seismic resistance is greatly improved by this invention. Other structural shapes, such as an angle or a channel, can be used in place of T-beam 17.

Figure 3:
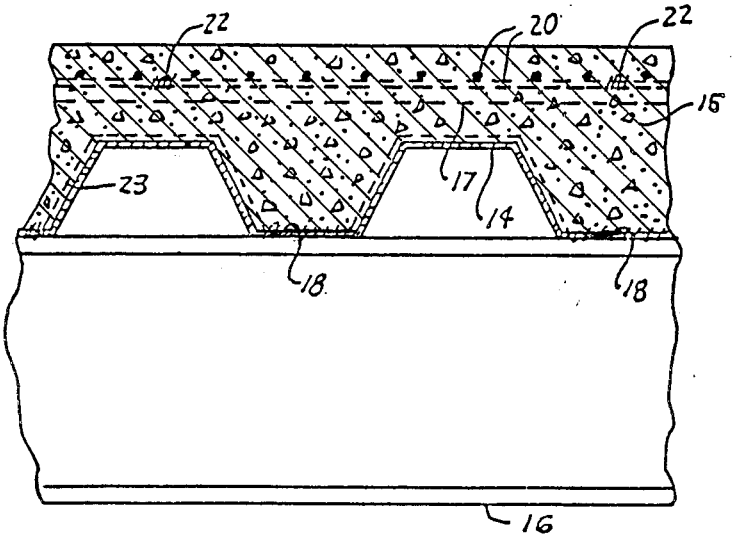
FIG. 3 is a typical fragmentary cross-sectional view taken along line 3—3 of FIG. 1 showing the cross-section of the steel deck floor supported on the composite beam of this invention.

FIG. 3 shows a typical cross-section of the composite beam of this invention taken along line 3—3 of FIG. 1. The wire mesh 20 is positively secured to the top flange of the T-beam 17 by spaced apart tack welds 22 . The wire mesh 20 can be stretched between the T-beams 17 before applying the tack welds 22. In this manner, the proper wire mesh location is ensured during the concreting operation without the labor of placing the mesh supporting chairs. The T-beam 17 is notched as shown by the dashed line 23 to prevent interference with the profile of the steel deck 14. The bottom end of the T-beam 17 is structurally connected to the top flange of the supporting beam 16 by the welds 18 penetrating through the bottom flange of the steel deck 14. Even though the bottom of the T-beam 17 is connected to the supporting beam 16 in a spaced apart fashion at the valleys of the steel deck 14, these connections are integral parts of the T-beam 17. Therefore, the longitudinal shear transferring capacity is limited only by the strength of the welds 18 and is not affected by the geometry of the deck profile. The stud efficiency problem of a studded composite beam design is eliminated by this invention.

Figure 4:
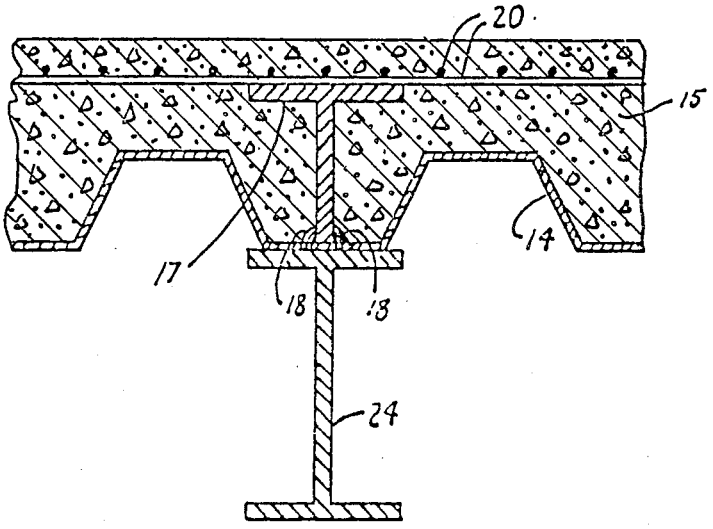
FIG. 4 is a typical fragmentary cross-sectional view taken along line 4—4 of FIG. 1 showing the cross-section of the composite beam of this in a girder position.

FIG. 4 shows a typical cross-section of the composite beam design of this invention in a girder application taken along line 4—4 of FIG. 1. In a girder application, the corrugations of the steel deck 14 are parallel to the longitudinal direction of the girder. Therefore, to incorporate this invention into the composite girder design, it is necessary to layout the steel deck 14 such that one of the steel deck valleys will be positioned on top of the bottom supporting girder. Similar to the previously explained composite beam design of this invention, the composite girder is formed by a T-beam 17 being connected to the bottom supporting girder 24 using welds 18 and an overlaying concrete slab 15 above the steel deck 14. The wire mesh 20 is supported on top of the T-beam 17. In the girder application, the T-beam 17 need not be notched.

Figure 5:
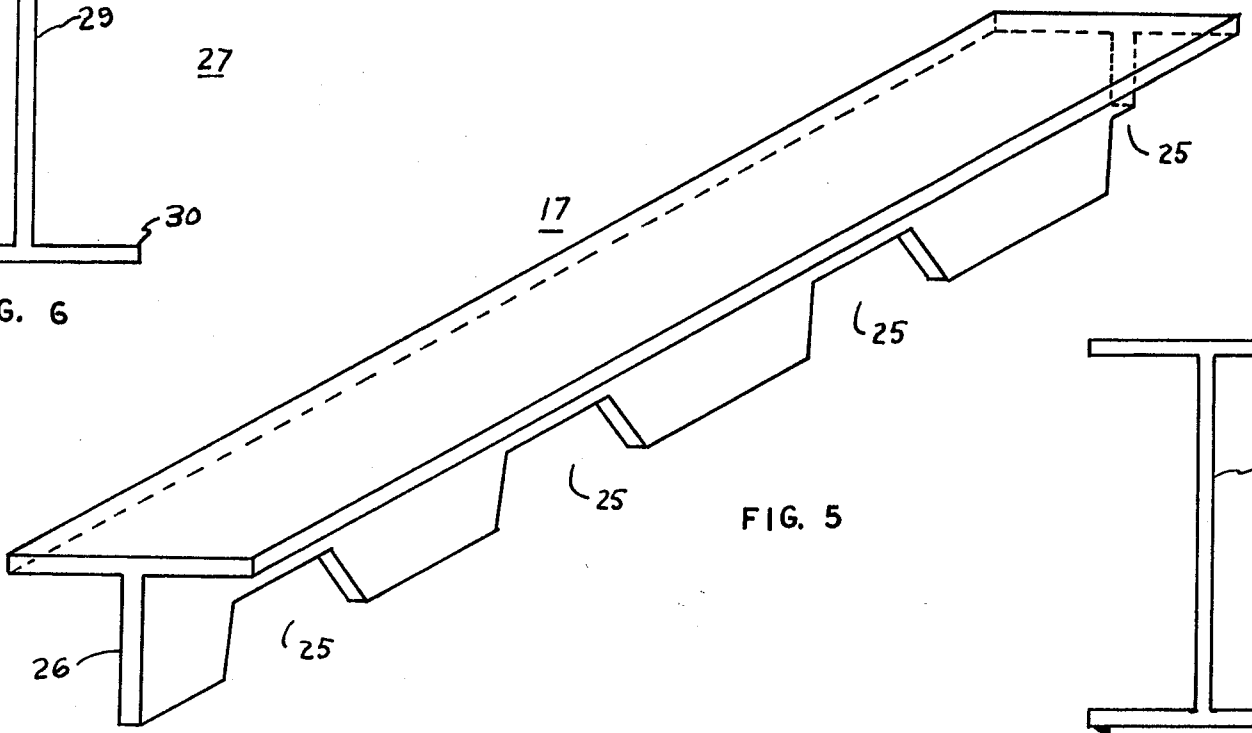
FIG. 5 is an isometric view of a typical T-beam fragment used as the shear transferring device of the composite beam construction of this invention.

FIG. 5 is an isometric view of a segment of the T-beam 17 useful in this invention. Notches 25 on the vertical leg 26 of the T-beam 17 are provided to prevent interference with the steel deck profile.

Figure 6:
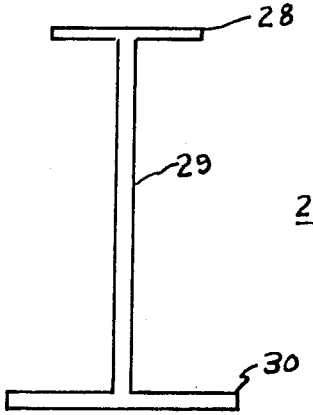
FIG. 6 is a typical optimized beam profile useful in the composite beam construction of this invention.

FIG. 6 shows a typical supporting beam profile 27 which is optimal for use in this invention. The optimal supporting beam profile 27 consists of a top flange 28, a web 29, and a bottom flange 30. The construction loading history of the buildup composite beam of this invention includes the following two stages. The first stage loading is during the erection of the steel decks and is resisted by the supporting beam. The second stage loading is during the concreting operation and is resisted by the combined action of the T-beam and the supporting beam. The second stage loading is much larger than the first stage loading and is mainly resisted by the bending strength provided by the top flange of the T-beam and the bottom flange of the supporting beam with little contribution by the top flange of the supporting beam. Similarly, the top flange of the supporting beam has little contribution to the bending strength of the composite section due to its proximity to the composite neutral axis. Therefore, the optimal profile of the supporting beam will have a thinner and narrower top flange as compared to the bottom flange. A thinner top flange will also facilitate the use of selfdrilling self-tapping screws for fastening the steel deck to the top flange of the supporting beam.

Figure 7:
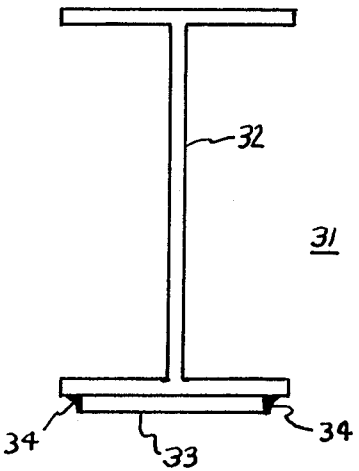
FIG. 7 is another typical optimized beam profile having a strengthened bottom flange useful in the composite beam construction of this invention.

FIG. 7 shows another typical optimal supporting beam profile 31 useful for the buildup composite beam design of this invention. This optimal beam profile 31 consist of a regular symmetrical wide flanged beam 32 with thinner flanges and a stiffening steel plate 33 being structurally connected to the bottom flange of the beam 32 by welds 34.

While I have illustrated and described several embodiments on my invention, it will be understood that these are by way of illustration only and that various changes and modifications may be contemplated in my invention and within the scope of the following claims.

I claim:

1. In a building floor structure having horizontal steel beams, steel decks supported on said steel beams, a concrete floor covering with shrinkage control wire mesh thereabove, and shear transferring devices enabling said steel beams to coact compositely with said concrete floor, each of said steel beams having a top flange, a vertical web, and a bottom flange, said steel decks having corrugations consisting of alternating ridges and valleys, said steel decks spanning between said steel beams and secured to said top flanges of said steel beams at said valleys, the improvements in the floor structure comprising:

said shear transferring device being connected to said top flange of said steel beam by welding through said steel decks and embedded in said concrete floor and comprising:

(a) a vertical element substantially parallel to said web of said steel beam and having a height greater than the height of said steel decks and extending into said valleys with clearance notches around said ridges and making contact with said steel decks.

(b) a continuous horizontal element having a linear axis substantially parallel to the longitudinal axis of said steel beam and extending laterally away from said vertical element and above said steel decks.

(c) said vertical element (a) being integrally connected with said horizontal element (b).

2. The improvement of claim 1 wherein said shrinkage control wire mesh being supported on said horizontal element and secured in position by spaced apart tack welds.

3. In a building floor structure of claim 1; the method comprising securing steel decks to said top flanges of said steel beams, welding said shear transferring devices at said valleys through said steel decks onto said top flanges of said steel beams, laying said wire mesh on said horizontal elements of said shear transferring devices, securing said wire mesh to said horizontal element by spaced apart tack welds, and pouring concrete on said steel decks burying said shear transferring devices and said wire mesh.

* * * * *